United States Patent [19]

Siebert et al.

[11] 4,417,518

[45] Nov. 29, 1983

[54] DETONATING ARRANGEMENT FOR MISSILES

[75] Inventors: Rainer Siebert, Schwaig; Dietmar Stützle, Lauf/Pegn; Peter Weidner, Breitenbrunn, all of Fed. Rep. of Germany

[73] Assignee: Diehl GmbH & Co., Nuremberg, Fed. Rep. of Germany

[21] Appl. No.: 24,428

[22] Filed: Mar. 8, 1979

[30] Foreign Application Priority Data

Mar. 8, 1978 [DE] Fed. Rep. of Germany ... 7806953[U]

[51] Int. Cl.[3] ..... F42C 13/08

[52] U.S. Cl. ..... 102/212; 102/216

[58] Field of Search ..... 102/212, 216, 210, 209, 102/206, 200

[56] References Cited

U.S. PATENT DOCUMENTS

| | | | |
|---|---|---|---|
| 2,791,963 | 5/1957 | Schuler et al. | 102/216 |
| 3,001,476 | 9/1961 | Boykin | 102/212 |
| 3,585,419 | 6/1971 | Andre | 102/210 |

*Primary Examiner*—Charles T. Jordan

*Attorney, Agent, or Firm*—Scully, Scott, Murphy & Presser

[57] ABSTRACT

A detonating arrangement for missiles in which, as a result of a change of the magnetic field of a permanent magnet at an approach to a ferromagnetic object, a voltage will be induced in an induction element, which is transmissible to the control input of electronic evaluating circuit powering a detonating medium.

5 Claims, 1 Drawing Figure

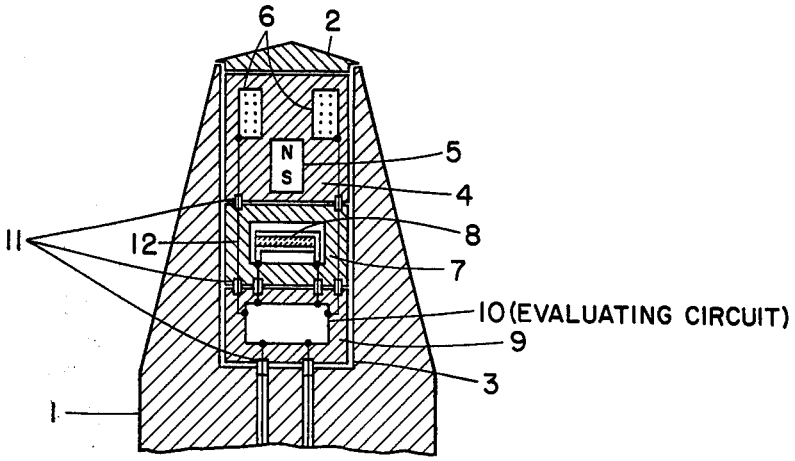
6
2
N
S
5
4
8
11
12
7
10 (EVALUATING CIRCUIT)
9
3
1

DETONATING ARRANGEMENT FOR MISSILES

BACKGROUND OF THE INVENTION

1. Field of the Invention

The present invention relates to a detonating arrangement for missiles in which, as a result of a change of the magnetic field of a permanent magnet at an approach to a ferromagnetic object, a voltage will be induced in an induction element, which is transmissible to the control input of electronic evaluating circuit powering a detonating medium.

2. Discussion of the Prior Art

A detonating arrangement of that type has already become known from U.S. Pat. No. 3,001,476. This known detonating arrangement consists of a permanent magnet arranged in the tip of the missile, as well as an antenna externally mounted on the missile, in which a voltage is induced responsive to a change of the magnetic field of the permanent magnet and conducted along to the control grid of a triode. The last-mentioned triode is a component of an electronic evaluating circuit through which a detonating medium is acted upon at the presence of that kind of control signal.

Hereby, the known detonating arrangement is subject to the disadvantage that it is exclusively adapted for the combating of ferromagnetic target objects. This known detonating arrangement will not respond even at impact against target objects formed of non-magnetic materials. In accordance therewith, even at impact against the ground no detonation will take place.

SUMMARY OF THE INVENTION

Accordingly, it is an object of the present invention to provide a detonation arrangement of the above-mentioned type in which, independently as to whether or not it relates to a ferromagnetic target object, will in all instances afford a detonation at impact.

The foregoing object is achieved by the disclosure in that the detonating arrangement, in addition to the permanent magnets and an adjoinly arranged magnetic proximity sensor consisting of a coil serving as an induction element, includes an impact sensor which can be coupled to the electronic evaluating cicuit.

A particularly inexpensive possibility for producing the inventive detonating arrangement is obtained when the magnetic proximity sensor as well as the electronic evaluating circuit are each constructed of modules which are provided with connector elements, and wherein the additional impact sensor can be inserted as a further module into the electronic evaluating circuit. The individual components of the detonating arrangement can in this manner, be rapidly assembled and without difficulties but, depending upon need, can also be individually employed in conjunction with the electronic evaluating circuit. As a result, not only is there enhanced the flexibility and range of applicability of a missile which is equipped with such a detonating arrangement, but also the storageability thereof is substantially simplified.

Particularly adapted herein for such an impact sensor for the inventive detonating arrangement are electrical or magnetic impact sensors since they can be combined with the electronic evaluating circuit for the magnetic proximity sensor without the utilization of additional switch elements. In order to be able to achieve the response of the detonating arrangement even at relatively low striking angles against non-ferromagnetic targets, particularly advantageous is the utilization of a piezoceramic cell as the impact sensor. Suitably, this is constructed as a module which can be inserted into the electronic evaluation circuit.

BRIEF DESCRIPTION OF THE DRAWING

Detailed herein below is an exemplary embodiment of the invention, taken in conjunction with the drawing. The single FIGURE of the drawing shows a longitudinal section through a missile in the tip of which there is arranged a detonation arrangement pursuant to the invention.

The tip of the missile 1 includes a hollow chamber 3 for the receipt of the detonating arrangement, which is closed off by a threaded cap 2. This arrangement consists of a first module 4 which contains a magnetic proximity sensor constituted of a permanent magnet 5 and an adjoinly located coil 6, a second module 7, and an impact sensor 8, in this instance, a piezoceramic cell, as well as a third module 9 in which there is arranged the electronic evaluating circuit 10.

The individual modules are interconnected by connector elements 11 concurrently serving as contacts, and fixed in their mutual positions. Hereby, in the presently illustrated embodiment, the magnetic impact sensor is connected by means of through-passing contact pins 12 which are embedded in the module 7 with the corresponding inputs of the electronic evaluating circuit. In the same manner, the electronic evaluating circuit 10 is connected by means of that type of connector elements 11 with a detonating medium, not disclosed herein, which after being addressed through the electronic evaluating circuit, is supplied with ignition energy from the also not herein disclosed and known ignition voltage generator which has a discharge circuit.

At an approach of the missile to a ferromagnetic target object, this generates an induction shock therein through the produced change in the magnetic field of the permanent magnet 5 which to a large extent transverses the coil 6. The so induced voltage is conducted along to the input of the electronic evaluating circuit 10 which, thereupon, energizes the detonating medium.

If in contrast to the foregoing the target object pertains, for instance, to a vehicle with ceramic armor, or one such formed of aluminum, or to another non-ferromagnetic object, then the magnetic proximity sensor will not respond. In lieu thereof, at impact against the target there is produced a voltage shock in the piezoceramic cell of the impact sensor 8 which will now similarly cause the detonation of the detonating medium through the evaluating circuit 10. Effected in the same manner is also the detonation upon the missile striking the ground.

What is claimed is:

1. Detonating arrangement for missiles in which a voltage is inducible in an induction element responsive to a change of the magnetic field of a permanent object at the approach to a ferromagnetic object, the voltage being conductable to the control input of an electronic evaluating circuit addressing a detonating medium; characterized in that the detonating arrangement includes an impact sensor (8) adapted to be coupled to the electronic evaluating circuit (10) in addition to a magnetic proximity sensor constituted of a permanent magnet (5) and an adjoinly located coil serving as the induction element.

2. Detonating arrangement as claimed in claim 1, characterized in that the magnetic proximity sensor and the electronic evaluating circuit (10) are formed as modules (4, 9) having connector elements (11), and wherein the additional impact sensor (8) is a further module (7) insertable into the electronic evaluating circuit (10).

3. Detonating arrangement as claimed in claim 1 or 2, characterized in that the impact sensor (8) is an electrical impact sensor.

4. Detonating arrangement as claimed in claim 3, characterized in that said impact sensor is formed of a module (7) constituted of a piezoceramic cell.

5. Detonating arrangement as claimed in claim 1 or 2, characterized in that the impact sensor (8) is a magnetic impact sensor.

* * * * *